US006213101B1

(12) United States Patent
Numbers et al.

(10) Patent No.: US 6,213,101 B1
(45) Date of Patent: Apr. 10, 2001

(54) METHOD AND APPARATUS FOR BLOCKING FLUID AND FUEL VAPORS

(76) Inventors: James W. Numbers, 6189 Pleasant St., East China, MI (US) 48054; Harold H. Zaima, 635 N. Glengarry Rd., Bloomfield Hills, MI (US) 48301; George J. Tilli, 44248 Rivergate, Clinton Township, MI (US) 48038; John Nye, 2988 Shorewood Blvd., Fort Gratiot, MI (US) 48059

( * ) Notice: Subject to any disclaimer, the term of this patent is extended or adjusted under 35 U.S.C. 154(b) by 0 days.

(21) Appl. No.: 09/430,592

(22) Filed: Oct. 29, 1999

(51) Int. Cl.[7] ..... F02M 37/04
(52) U.S. Cl. ..... 123/516; 174/151; 439/936
(58) Field of Search ..... 123/516, 509; 174/151; 439/587, 606, 936

(56) References Cited

U.S. PATENT DOCUMENTS

| | | | | |
|---|---|---|---|---|
| 3,308,316 | * | 3/1967 | Pfahl | 174/18 |
| 4,012,282 | | 3/1977 | Hutter et al. . | |
| 4,061,344 | | 12/1977 | Bradley et al. . | |
| 4,104,484 | | 8/1978 | Ijlstra et al. . | |
| 4,107,456 | | 8/1978 | Schuster et al. . | |
| 4,213,004 | | 7/1980 | Acker et al. . | |
| 4,492,421 | * | 1/1985 | Ito | 174/152 R |
| 4,599,487 | | 7/1986 | Blank et al. . | |
| 4,982,055 | | 1/1991 | Pollack et al. . | |
| 5,194,697 | | 3/1993 | Hegner et al. . | |
| 5,278,357 | * | 1/1994 | Yamanashi | 174/151 |
| 5,406,032 | | 4/1995 | Clayton et al. . | |
| 5,596,176 | | 1/1997 | Everitt . | |
| 5,631,445 | | 5/1997 | Herster | 174/151 |

* cited by examiner

*Primary Examiner*—Thomas N. Moulis
(74) *Attorney, Agent, or Firm*—Harness, Dickey & Pierce, PLC

(57) ABSTRACT

A method and apparatus for blocking fluid and fuel vapors having a broken, but welded contiguous set of electrical wires passing through bores formed in a plug body. Each wire having been cut, stripped of insulation and welded back together within the bores to form a welded section of virtually solid copper. The welded section and a portion of the insulation is then overmolded with a fuel resistant plastic resin which further interrupts and eliminates fluid leakage and fluid vapor migration.

20 Claims, 3 Drawing Sheets

METHOD AND APPARATUS FOR BLOCKING FLUID AND FUEL VAPORS

BACKGROUND OF THE INVENTION

1. Technical Field

The present invention relates generally to a method and apparatus for blocking fluid and fuel vapors. More particularly, the present invention relates to a unique method and construction of an apparatus for preventing fluid leakage and vapor migration through the use of electrical wires.

2. Discussion

Conventional automotive fuel delivery systems utilize an electric fuel pump mounted in a fuel tank to deliver fuel from the fuel tank to the engine. Power is supplied to the fuel pump through electric wires connected between the fuel pump and a voltage source such as an alternator or a vehicle battery. In order to reach the fuel pump, the electrical wires must pass through an opening in the fuel tank. Such an opening, unless properly sealed, potentially provides a pathway for fluid leakage and fluid vapor migration commonly referred to as vapor permeation. Minimizing such fluid leakage and vapor permeation is desirable due to increasing regulations regarding automotive fuel vapor emissions and overall product efficiency.

Several attempts to seal this opening in the fuel tank have been developed. Many of these contributions to the art include a bushing or a fitting adapted for placement in the opening. The electrical wires then pass through this bushing or fitting. Although the wires are fitted together as tightly as possible through the bushing or fitting, spaces or pores inevitably exist through which fluid leakage and vapor permeation is released.

In other contributions to the art, fluid leakage and vapor permeation is attempted to be prevented through the use of numerous continuous wires, the center portions of which are stripped of insulation. A plug is then placed over the exposed center insulation stripped wire portion. The entire composite is then blocked through a chemical bath treatment. Such a contribution is illustrated in U.S. Pat. No. 5,631,445 (Herster). Such contributions typically include production processes which are laborious and expensive, further possibly requiring separate internal and external harnesses. Moreover, the use of insulated continuous wire is rather costly and wasteful since this high end type of wire is only required in the area inside the fuel tank and not throughout the entire vehicle. Wires in the fuel tank are typically specially cured such as through chemical baths or through exposure to radiation to strengthen their various necessary attributes. This greatly increases the cost of the wires.

As set forth above, in order to maintain electrical integrity, the electrical wires are typically wrapped with expensive insulation. Some such wire insulation swells when exposed to fluid or vapor permeation which may cause cracking and/or breakage. Other types of insulation shrink when exposed to fluid or vapor permeation, thus increasing the size of the pathway through which fluid leakage or vapor permeation may escape. When the insulation on the wires passing through a fitting deteriorates due to shrinking or swelling, or when the wires are not sufficiently bound to the fitting, the area between the wire and the fitting are widened providing a greater pathway through which fluid leakage or vapor permeation may be released.

In other processes, the center of the conductors is stripped and through a vacuum process, a fuel resistant sealant is introduced to fill the pores between the wires and the fitting.

New wire is also being developed which includes a blocking agent added during the extrusion process.

The current contributions to the art do not effectively compensate for the problems set forth above, in part by failing to adequately seal and close the space between the wires and the fitting, and by failing to sufficiently bond the wires to the fitting. In order to overcome the problems associated with the current contributions to the art, various designs and methods for blocking fluid and fuel vapors have been developed. The continued development has been directed to designs which simplify the manufacturing process and assembly while keeping costs at a minimum and performance at a maximum.

SUMMARY OF THE INVENTION

It is a principal object of the present invention to provide a method and apparatus for blocking fluid and fuel vapors which eliminates the minute pathways from which fluid leakage and vapor permeation may escape. The term "fluid" will be used throughout, however, it will be appreciated that this term includes both fluid and vapor.

A related object of the present invention is to provide a method and apparatus for blocking fluid and fuel vapors which allows for the use of a solid wire inside the fuel tank and a more cost effective wire outside the fuel tank.

It is another object of the present invention to provide a method and apparatus for blocking fluid and fuel vapors which includes welding two separate wires together forming one continuous wire, wherein a consistent, solid barrier is created within the weld. This welded section is then overmolded with a fuel resistant plastic resin.

It is still yet another object of the present invention to provide a method and apparatus for blocking fluid and fuel vapors which is inexpensive to manufacture and easy to install.

It is another object of the present invention to provide a method and apparatus for blocking fluid and fuel vapors which does not require the laborious and costly process of dipping the wires into a chemical bath.

It is another object of the present invention to provide a method and apparatus for blocking fluid and fuel vapors that utilizes a more costly, solid, insulated wire inside the fuel tank and a more cost effective automotive grade wire outside the fuel tank.

In one form, the present invention provides a method for blocking fluid and fuel vapors including electrical wires. The method of the present invention includes the general steps of cutting an electrical wire and stripping the wire of its insulation at the cut ends. The wires are then bonded back together through the use of welding. The term "welding" will be used throughout, however, it will be appreciated that any commonly known bonding or adhering means may be utilized including, but not limited to, soldering, ultra sonic welding, resistance welding, tungsten-inert gas (hereinafter "TIG") welding, or gas metal arc welding. Finally, this welded section, plus a portion of the wire insulation is overmolded with a fuel resistant plastic resin.

In another form, the present invention provides an apparatus for blocking fluid and fuel vapors including electrical wires which are cut and stripped of their insulation at the cut ends. The wires are then bonded back together through the use of welding. The welded section, plus a portion of the wire insulation, is then overmolded with a fuel resistant plastic resin.

Other advantages, benefits and objects of the present invention will become apparent to those skilled in the art from a reading of the subsequent detailed description, appended claims and accompanying drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
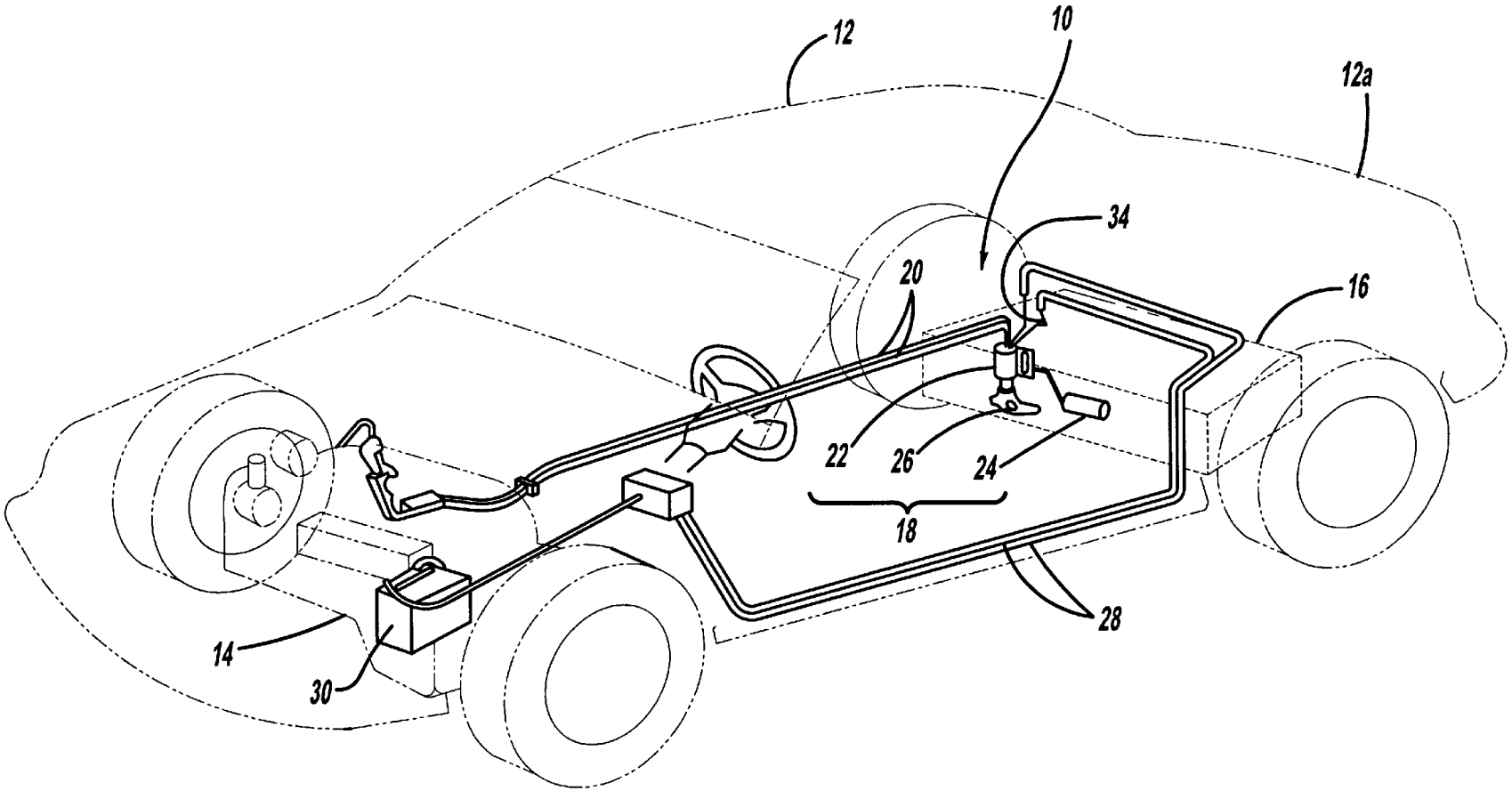
FIG. 1 is an environmental view of a method and apparatus for blocking fluid and fuel vapors constructed in accordance with the teachings of a preferred embodiment of the present invention shown incorporated into a motor vehicle, the remainder of the vehicle is shown in phantom lines.

Referring now to the drawings, there is depicted an apparatus for blocking fluid and fuel vapors embodying the concepts of the present invention. The apparatus of the present invention is generally identified in the drawings with reference numeral 10 and is shown in FIG. 1 adapted to cooperate with a specific fuel delivery system of a motor vehicle 12. However, the teachings of the present invention are more broadly applicable to other automotive applications where fluid leakage and/or vapor migration prevention is desirable (i.e., transmission harnesses).

Prior to addressing the construction and operation of the apparatus 10 of the present invention, a brief understanding of the exemplary fuel delivery system of the motor vehicle 12 shown in FIG. 1 is warranted. The environmental view of FIG. 1 illustrates the apparatus 10 operatively attached to a fuel delivery system of the vehicle 12. The fuel delivery system provides fuel to an engine 14 and includes a fuel tank 16 located in a rear section 12*a* of the vehicle 12 in which a fuel delivery module 18 is mounted in any commonly known manner. The fuel delivery system also includes a pair of fuel lines 20, one for delivering fuel from the fuel tank 16 to the engine 14 and the other for returning fuel from the engine 14 to the fuel tank 16. Fuel delivery module 18, which is mounted to the fuel tank 16, has an electric fuel pump 22 connected to one of the fuel lines 20, a pump sender 24 for signaling the fuel level within the fuel tank 16, and a fuel filter 26 on an inlet side of the electric fuel pump 22. Electrical wires 28 pass through the fuel tank 16 to supply the electric fuel pump 22 and the pump sender 24 with electrical power from a battery 30. A plug body 34 according to the present invention provides a sealed conduit for the electrical wires 28 to pass through the fuel tank 16 while minimizing fluid leakage and vapor permeation therefrom. As will be understood by those skilled in the art, FIG. 1 is for illustrative purposes only and not meant to indicate a specific vehicle or fuel delivery system, and is but one adaptation for which the present invention can appropriately be used.

Figure 2:
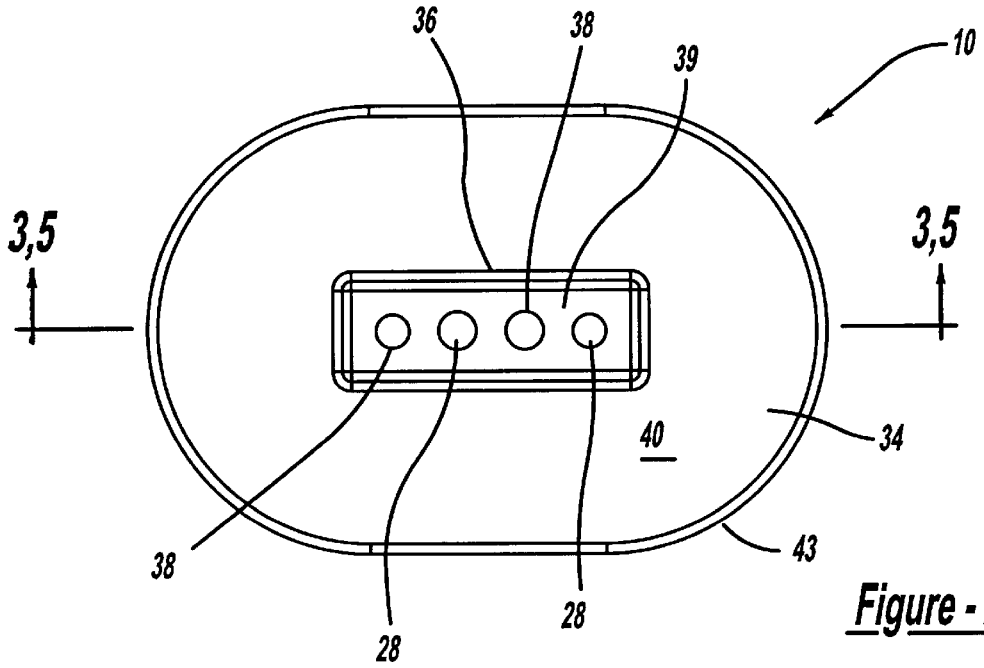
FIG. 2 is a top view of the method and apparatus for blocking fluid and fuel vapors shown in FIG. 1.
Figure 3:
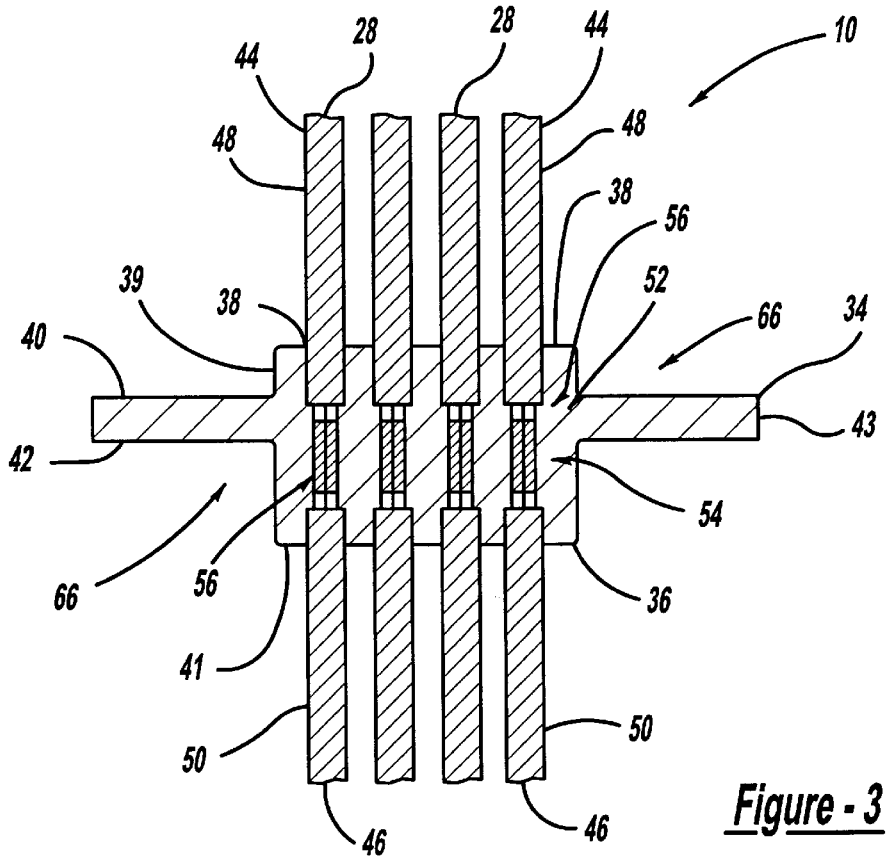
FIG. 3 is a sectional view taken along the line 3—3 of FIG. 2.

Referring now to FIG. 2 and FIG. 3, the apparatus for blocking fluid and fuel vapors 10 is shown including the plug body 34. The plug body 34 includes an enlarged central portion 36 having a plurality of bores 38 formed therethrough. The enlarged central portion 36 is preferably integrally formed with the plug body 34, and includes an upwardly projecting portion 39 projecting upward from a top surface 40 and a downwardly projecting portion 41 projecting downward from a bottom surface 42. The plug body 34 is fitted into an opening in the fuel tank 16 and is welded to the fuel tank 16 in such a manner that the downwardly projecting portion 41 of the enlarged central portion 36 extends downward into the fuel tank 16. The plug body 34 is fitted into the opening in the fuel tank 16 such that a perimeter portion 43 of the plug body 34 is welded over the opening in the fuel tank 16.

As illustrated in FIG. 3, the electrical wires 28 pass through the bores 38 formed in the enlarged central portion 36 of the plug body 34. The electrical wires 28 may include a first wire 44 and a second wire 46. The first wire 44 is located outside the fuel tank 16 and is typically a more cost effective automotive grade wire commonly known in the industry, or a stranded electrical wire, or a solid electrical wire. The second wire 46 is located in the fuel tank 16 and is typically specially cured such as through chemical baths or through exposure to radiation to strengthen its various necessary attributes, or a stranded electrical wire, or a solid electrical wire. The first wire 44 and the second wire 46 have insulation 48 and 50, respectively, thereon to secure electrical integrity and prevent short circuits as is commonly known. Preferably, the insulation 50 of the second wire 46 is fuel resistant, for example, a moisture cured or irradiated, high density polyethylene insulation, which swells only minimally when exposed to fuel so as to prevent cracking and breaking of the insulation 50 of the second wire 46 located in the fuel tank 16. In some instances, the second wire 46 having fuel resistant insulation 50 secured thereon may be used not only inside the fuel tank 16 but also outside the fuel tank 16 as well. In such instances, the wire is cut into two pieces prior to its placement within the bores 38 formed in the enlarged central portion 36 of the plug body 34.

With continued reference to FIG. 3, the first wire 44 and the second wire 46 have end portions 52 and 54, respectively. The end portions 52 and 54 are encased within the plug body 34. The insulation 48 of the first wire 44 is stripped at the end portion 52. Likewise, the insulation 50 of the second wire 46 is stripped at the end portion 54. The stripped end portion 52 of the first wire 44 and the stripped end portion 54 of the second wire 46 are then bonded back together through welding. Thus forming one contiguous wire having a welded wire section 56. In instances where one contiguous piece of wire is utilized, which has been cut into two pieces prior to placement within the bores 38, each end portion is similarly stripped of its insulation and then bonded back together as described above. This process thus creates a welded wire section 56 of solid, or virtually solid copper, which eliminates a pathway for fluid leakage and vapor permeation. Due to the constraints of the welding equipment, the welded wire section 56 does not butt up against the insulation.

Figure 4:
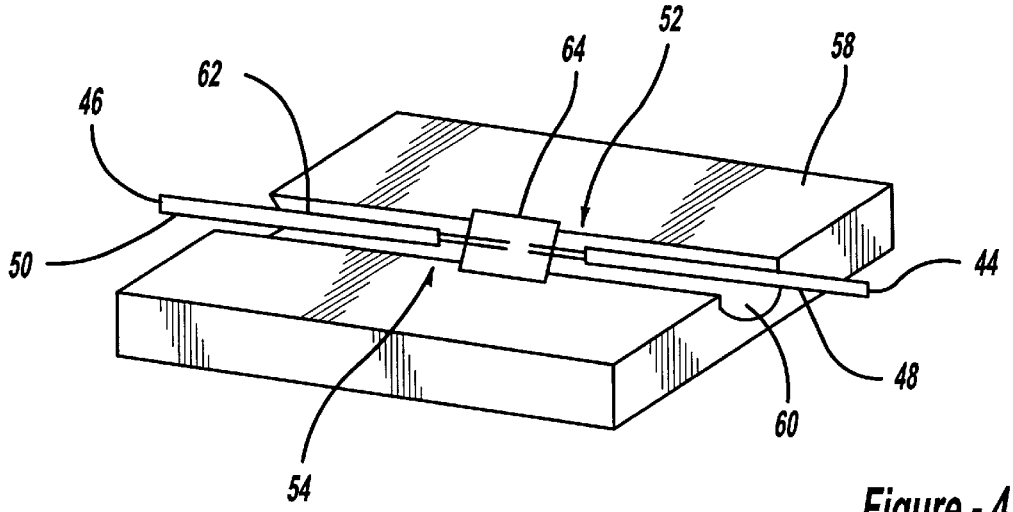
FIG. 4 is a perspective view of a forming nest used in association with a TIG welding process in accordance with the teachings of a preferred embodiment of the present invention.

Referring now to FIG. 4, an alternative welding process is illustrated using a forming nest. As is commonly known in the industry, TIG welding is welding in which an arc from a nonconsumable tungsten electrode radiates heat onto a work surface, to create a weld puddle in a protective atmosphere provided by a flow of inert shielding gas. Pressure may or may not be used and filler metal may or may not be used. The forming nest includes an upper portion (not shown) and a lower portion 58. The upper portion (not shown) of the forming nest is substantially similar to and a mirror image of the lower portion 58 of the forming nest. The upper portion of the forming nest differs primarily from the lower portion 58 in having a passageway extending vertically throughout its entire height. As illustrated in FIG. 4, the lower portion 58 of the forming nest is provided having a first channel 60 and a second channel 62 formed therein. The first channel 60 and the second channel 62 formed in the lower portion 58 of the forming nest are adapted to receive the first wire 44 and the second wire 46. Also formed in the lower portion 58 of the forming nest, between the first channel 60 and the second channel 62, is a central mold region 64. The central mold region 64 can be of any geometric shape, for example, a sphere, a rectangle or any other shape that is required by the end user.

During the TIG welding process, as illustrated in FIG. 4, the first wire 44 is received in the first channel 60 and the second wire 46 is received in the second channel 62, such that the stripped end portion 52 of the first wire 44 and the stripped end portion 54 of the second wire 46 each extend into the central mold region 64. It is appreciated by one skilled in the art that the first wire 44 is equally capable of being received in the second channel 62 while the second wire 46 is equally capable of being received in the first channel 60. During the welding process, a weld puddle is then captured in the central mold region 64 formed in the lower portion 58 of the forming nest. Thereafter, a weld nugget in the desired geometric shape, the geometric shape of the central mold region 64, is created. The weld nugget formed is a solid, consistent mass of copper.

Following the welding process, the welded wire section 56 or the weld nugget, plus a portion of the insulation 48 of the first wire 44 and a portion of the insulation 50 of the second wire 46 are overmolded with a fuel resistant plastic resin, by way of example, in the acetyl family, to form an overmolded section 66. Accordingly, the overmold covers and bonds together a portion of the insulation 48 of the first wire 44, a portion of the insulation 50 of the second wire 46, and the welded wire section 56 or the weld nugget. Thus further interrupting and eliminating any pathways for fluid leakage and vapor permeation.

Figure 5:
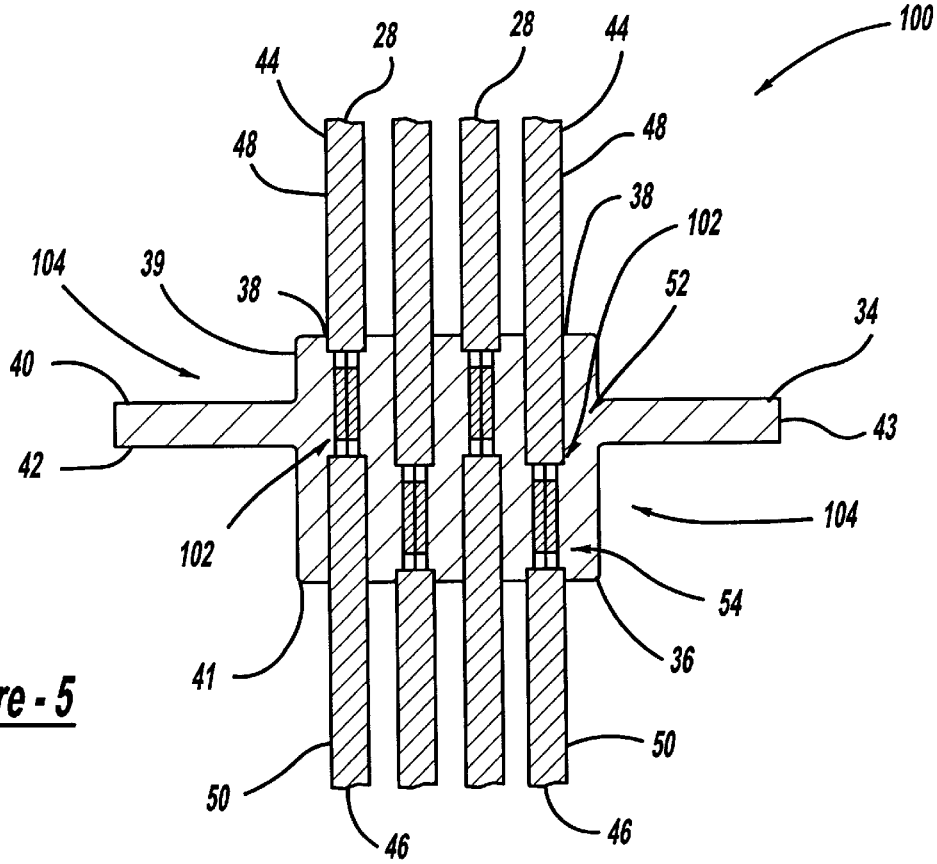
FIG. 5 is a sectional view taken along the line 5—5 of FIG. 2 illustrating a method and apparatus for blocking fluid and fuel vapors constructed in accordance with the teachings of a second preferred embodiment of the present invention.

An alternative embodiment of a method and apparatus for blocking fluid and fuel vapors 100 is illustrated in FIG. 5. The method and apparatus for blocking fluid and fuel vapors 100 differs primarily from the previous embodiment 10 in the location of the welded wire section 56 or the weld nugget. In the method and apparatus for blocking fluid and fuel vapors 100, like reference numerals will be used to describe like components.

In the method and apparatus for blocking fluid and fuel vapors 100, a welded wire section 102, or weld nugget, and an overmolded section 104 are created as described above. As illustrated in FIG. 5, the welded wire section 102 or the weld nugget (not shown) for each alternating electrical wire 28 of the method and apparatus for blocking fluid and fuel vapors 100 are staggered or offset. This formation further secures electrical integrity and further prevents short circuits as is commonly known.

A plug body 34 as described above provides a sealed closure which prevents fluid leakage and vapor permeation while also affording greater cost benefits by utilizing more costly wire only where needed.

While the above detailed description describes the preferred embodiment of the present invention, it should be understood and appreciated that the invention is susceptible to modification, variation and alteration without departing from the proper scope and fair meaning of the accompanying claims.

What is claimed is:

1. In a motor vehicle having a fuel delivery system including an electric fuel pump mounted in a fuel tank, the improvement comprising an apparatus for blocking fluid and fuel vapors including:

a plug body adapted to be fitted into the fuel tank having at least one bore formed therethrough;

a first electrical wire extending into said at least one bore formed in said plug body;

a second electrical wire extending into said at least one bore formed in said plug body, each of said first and second electrical wires having:

a portion having insulation secured thereto; and an end portion stripped of said insulation; and means for bonding said first electrical wire and said second electrical wire together such that fluid leakage and fluid vapor migration is eliminated.

2. The apparatus for blocking fluid and fuel vapors of claim 1, wherein said first electrical wire includes an automotive grade wire and said second electrical wire includes a fuel resistant wire.

3. The apparatus for blocking fluid and fuel vapors of claim 2, wherein said means for bonding comprise welding said end portions stripped of said insulation of said first electrical wire and said second electrical wire together to form a welded wire section.

4. The apparatus for blocking fluid and fuel vapors of claim 3, wherein said means for bonding further comprise overmolding said welded wire section, and said portions having insulation secured thereto of said first electrical wire and said second electrical wire together to form an overmolded section.

5. The apparatus for blocking fluid and fuel vapors of claim 4, wherein said overmolded section is overmolded with a fuel resistant plastic resin.

6. The apparatus for blocking fluid and fuel vapors of claim 3, wherein said welded wire sections are staggered in each alternating bore formed in said plug body.

7. An apparatus for blocking fluid and fuel vapors comprising:

a plug body having a plurality of bores formed therethrough;

a plurality of first electrical wires extending into one of said corresponding plurality of bores formed in said plug body;

a plurality of second electrical wires extending into one of said corresponding plurality of bores formed in said plug body, each of said plurality of electrical wires having:

a portion having insulation secured thereto; and an end portion stripped of said insulation; and means for bonding each of said plurality of first electrical wires and each of said plurality of second electrical wires together such that fluid leakage and fluid vapor migration is prohibited.

8. The apparatus for blocking fluid and fuel vapors of claim 7, wherein said plurality of first electrical wires comprise an automotive grade wire and said plurality of second electrical wires comprise a fuel resistant wire.

9. The apparatus for blocking fluid and fuel vapors of claim 8, wherein said means for bonding comprise welding said end portions stripped of said insulation of each of said plurality of first electrical wires and each of said plurality of second electrical wires together to form a welded wire section.

10. The apparatus for blocking fluid and fuel vapors of claim 9, wherein said welded wire sections are staggered in each alternating plurality of bores formed in said plug body.

11. The apparatus for blocking fluid and fuel vapors of claim 10, wherein said means for bonding further comprise overmolding said welded wire section, and said portions having insulation secured thereto of said plurality of first electrical wires and said plurality of second electrical wires together to form an overmolded section.

12. The apparatus for blocking fluid and fuel vapors of claim 11, wherein said overmolded section is overmolded with a fuel resistant plastic resin.

13. A method of blocking fluid and fuel vapors, the method comprising the steps of:

providing a plug body having a plurality of bores formed therethrough;

extending at least one of a plurality of first electrical wires into one of said corresponding plurality of bores formed in said plug body;

extending at least one of a plurality of second electrical wires into one of said corresponding plurality of bores formed in said plug body, each of said plurality of first and second electrical wires having insulation secured thereto;

stripping a portion of said insulation from each of said plurality of first and second electrical wires;

bonding each of said plurality of first and second electrical wires together such that fluid leakage and fluid vapor migration is prohibited.

14. The method of blocking fluid and fuel vapors of claim 13, further including the step of placing at least one of said plurality of electrical wires onto a forming nest prior to the step of bonding.

15. The method of blocking fluid and fuel vapors of claim 13, wherein said plurality of first electrical wires comprise an automotive grade wire and said plurality of second electrical wires comprise a fuel resistant wire.

16. The method of blocking fluid and fuel vapors of claim 15, wherein the step of placing comprises placing each of said plurality of first electrical wires into a first channel formed in said forming nest and placing each of said plurality of second electrical wires into a second channel formed in said forming nest.

17. The method of blocking fluid and fuel vapors of claim 16, wherein the step of bonding comprises welding said stripped portion of each of said plurality of first electrical wires and said stripped portion of each of said plurality of second electrical wires together to form a welded wire section.

18. The method of blocking fluid and fuel vapors of claim 17, wherein said welded wire sections are staggered in each alternating plurality of bores formed in said plug body.

19. The method of blocking fluid and fuel vapors of claim 18, wherein the step of bonding further comprises overmolding said welded wire section, and said portions having insulation secured thereto of said plurality of first electrical wires and said plurality of second electrical wires together to form an overmolded section.

20. The method of blocking fluid and fuel vapors of claim 19, wherein said overmolded section is overmolded with a fuel resistant plastic resin.

* * * * *